US005697574A

United States Patent [19]

Miyakoshi et al.

[11] Patent Number: 5,697,574

[45] Date of Patent: Dec. 16, 1997

[54] WINDING METHOD AND APPARATUS FOR WOUND GOLF BALLS

[75] Inventors: Naoki Miyakoshi; Hiroyuki Ohtawa; Hiroshi Aoki, all of Chichibu, Japan

[73] Assignee: Bridgestone Sports Co., Ltd., Tokyo, Japan

[21] Appl. No.: 642,356

[22] Filed: May 3, 1996

[30] Foreign Application Priority Data

May 12, 1995 [JP] Japan ..... 7-138554

[51] Int. Cl.[6] ..... A63B 47/00; B65H 54/64

[52] U.S. Cl. ..... 242/435.2; 242/418; 242/418.1

[58] Field of Search ..... 242/435.2, 435.1, 242/418, 419, 419.1, 419.2, 418.1

[56] References Cited

U.S. PATENT DOCUMENTS

| | | | |
|---|---|---|---|
| 1,662,003 | 3/1928 | Eldridge | 242/435.2 |
| 1,982,933 | 12/1934 | Sibley | 242/435.2 |
| 2,179,094 | 11/1939 | Joss | 242/435.1 |
| 2,425,909 | 8/1947 | Wilhelm | 242/435.2 |
| 4,783,078 | 11/1988 | Brown et al. | 273/216 |
| 5,133,509 | 7/1992 | Brown | 242/435.1 |

FOREIGN PATENT DOCUMENTS 5-45270 7/1993 Japan .

*Primary Examiner*—Katherine Matecki

*Attorney, Agent, or Firm*—Sughrue, Mion, Zinn, Macpeak & Seas, PLLC

[57] ABSTRACT

A wound core is formed by winding thread rubber (13) on a center (11) by holding the center (11) among three winding rollers (12), driving at least one winding roller to rotate the center, and feeding thread rubber (13) to the rotating center through a brake roller (16) and a delivery roller (14), thereby winding the thread rubber on the center under tension. The tension of thread rubber (13) is continuously measured upstream of the center by a tension gauge (42). The rotating condition of at least one of the winding roller (12), brake roller (16), and delivery roller (14) is adjusted in accordance with the tension measurement for adjusting the winding tension while winding the thread rubber on the center. When the tension of thread rubber is changed continuously or stepwise during winding, a wound core in which the hardness of the thread rubber layer varies continuously or stepwise in an thickness direction can be produced.

12 Claims, 7 Drawing Sheets

WINDING METHOD OF INVENTION

WINDING METHOD OF PRIOR ART

CHANGE OF TENSION
(TENSION RISE WITHIN ALL ACCELERATING TIME OF 0 msec.)

HARDNESS VERSUS WINDING TENSION

WINDING METHOD AND APPARATUS FOR WOUND GOLF BALLS

BACKGROUND OF THE INVENTION

1. Field of the Invention

This invention relates to the manufacture of a wound golf ball comprising a wound core having thread rubber wound on a spherical center and a cover enclosing the wound core. More particularly, it relates to a method and apparatus for winding thread rubber around the center to form the wound core.

2. Prior Art

In general, thread wound golf balls are manufactured by winding thread rubber around a spherical center, which is either a liquid center having a center bag of rubber filled with a liquid or paste or a solid center made of solid rubber, to form a wound core and enclosing the wound core with a cover. The winding process to form a wound core involves the steps of holding the spherical center among three winding rollers, driving the rollers to rotate the center, and feeding thread rubber to the surface of the rotating center under tension, thereby winding the thread rubber around the center.

Referring to FIG. 7, there is shown a typical winding apparatus. The winding method is described in conjunction with this winding arrangement. A spherical center 11 is placed among three winding rollers 12, 12, 12'. More particularly, one winding roller 12' presses the center 11 against the other winding rollers 12 and 12 so that the center 11 is held among the three rollers. The other winding rollers 12 and 12 are driven for rotation to thereby rotate the center 11 at a high speed. A rubber thread 13 is continuously fed from its supply (not shown) to the rotating center 11 through first and second brake rollers **16*a* and 16*b* for winding the thread rubber 13 around the center 11, obtaining a wound core. The first and second brake rollers 16*a* and 16*b* are not self driven, but are adapted to rotate about their axis when a predetermined rotational torque is given. As the center 11 rotates to take up the thread rubber 13, the first and second brake rollers 16*a* and 16*b* are rotated. By properly setting the rotational torque of the first and second brake rollers 16*a* and 16*b*, a predetermined tension is applied to the thread rubber 13 between the first and second brake rollers 16*a* and 16*b* so that the thread rubber 13 is stretched under tension. Also a predetermined tension is applied to the thread rubber 13 between the second brake roller 16*b* and the center 11 by the braking force (rotation resistance) of the second brake roller 16*b* whereby the thread rubber 13 is stretched to a predetermined rate of elongation. In this stretched state, the thread rubber 13 is wrapped around the center 11. Also included in the illustrated arrangement are holding rollers 18 disposed in contact with the first and second brake rollers 16*a* and 16*b* for pressing the thread rubber 13 against the rollers 16*a* and 16*b* to prevent the thread rubber from slippage, thread rubber guides 20 for guiding the thread rubber 13 from its supply (not shown) to the first and second brake rollers 16*a* and 16*b*, a ball holder 22 for pressing the winding roller 12' against the center 11, an instrument 24 for measuring the (final) outer diameter of the wound core for detecting the end of winding, a controller 26 for setting the number of revolutions of the winding rollers 12 and 12, a pressure dial 28 for adjusting the pressure of the ball holder 22, dials 30 and 32 for adjusting the rotation resistance of the first and second brake rollers 16*a* and 16*b*, respectively, a main power supply 34, and a switch 36** for turning on drives (not shown) to start the winding operation.

The winding method and apparatus shown in FIG. 7 have several problems. (1) It is difficult to regulate the hardness of wound cores to a target value. (2) Inadvertent thread rupture, deviation of a wound form from sphericity, and hardness variations occur frequently. (3) The manufacture is less efficient because of a limited rate of winding. (4) The winding tension cannot be altered during winding of thread rubber.

More particularly, the hardness of the wound core is largely governed by the tension of thread rubber wound on the center. Where the conventional winding method and apparatus shown in FIG. 7 is used, a wound core is manufactured to a desired hardness by regulating the necessary rotational torque (or braking force) of the first and second brake rollers **16*a* and 16*b* for thereby setting the tension of thread rubber 13 to be wound on the center 11. The setting of the winding tension is done by the operator who presets the braking force of the first and second brake rollers 16*a* and 16*b* prior to the start of winding operation by relying on his experience. At the end of winding operation, the resultant wound core is measured for hardness. The braking force of the first and second brake rollers 16*a* and 16*b*** is finely adjusted again in accordance with the measurement, thereby achieving the target hardness.

As a consequence, (1) a time-consuming adjustment is required before a wound core with a target hardness can be obtained. In a commercial plant, a multiplicity of wound cores of the same standard are simultaneously manufactured by a number of winding units while the winding units are managed by a plurality of operators. Then the wound cores will more or less vary in hardness among different operators and different winding units. It is thus difficult to regulate the hardness of wound cores precisely to the target value.

(2) Once the braking force of the first and second brake rollers **16*a* and 16*b*** is regulated and set prior to winding operation, it not readjusted during winding operation. It is likely that the tension of thread rubber become inconsistent during winding operation due to various factors, resulting in inadvertent thread rupture, deviation of a wound form from sphericity, and hardness variations.

(3) Since thread rupture often occurs at the start of winding operation due to inconsistent tension of thread rubber, the winding rollers 12, 12, 12' must be slowly driven for rotation at the start. The slow start is less efficient. The setting of the winding tension by regulating the braking force of the first and second brake rollers **16*a* and 16*b* is carried out by relying on the operator's experience, the adjustment of the winding tension is very difficult when winding is done at a very high speed. The winding tension is very unstable during winding operation. For these and other reasons, the rotational speed of the winding rollers 12, 12, 12'** during winding is limited, prohibiting efficient, high speed winding.

(4) Since the braking force of the first and second brake rollers **16*a* and 16*b*** is regulated and set prior to winding operation and the winding of thread rubber is continued under identical conditions until the end of winding, it is impossible to alter the winding tension of thread rubber continuously or stepwise in a radial or thickness direction of the thread rubber layer to produce a wound core in which the hardness of the thread rubber layer is changed between its inner and outer strata.

With respect to the last-mentioned drawback (4), Japanese Patent Publication (JP-B) No. 45270/1993 discloses a winding method capable of altering the winding tension midway winding of thread rubber. This method is illustrated in FIG.

8. A rubber thread 13 is fed from its supply 80 to a rotating center 11 through a low-tension wheel 82 and a high-tension wheel 84 for winding the thread rubber on the center to form a wound core. Up to a predetermined time set by a timer 86 and a predetermined thickness of a thread rubber layer managed by a gage meter 88 for detecting the diameter of the wound core, the high-tension wheel 84 is kept inoperative and the thread rubber 13 is wound on the center under a relatively low tension regulated solely by the low-tension wheel 82. The timer 86 and the gauge meter 88 detect the time when the thread rubber layer reaches the predetermined thickness. At this point, the high-tension wheel 84 is made operative and the thread rubber 13 is wound on the center under a relatively high tension. This method permits the winding tension of thread rubber 13 to be altered in two stages in a thickness direction of the thread rubber layer, producing a wound core in which the hardness of the thread rubber layer is changed between its inner and outer strata. It is noted that the center 11 rests on a rubber belt 90 which is driven by a motor 92 for rotating the center.

In this winding method, the setting of the winding tension by the low and high-tension wheels 82 and 84 is previously carried out. The winding tension is altered stepwise midway the winding process by switching the high tension wheel 84 operative although the winding tension is not adjusted in each of the first and second stages of winding. Therefore, the above-mentioned problems (1) to (3) are not solved. Since this winding method is to alter the winding tension by merely switching the second or high-tension wheel 84 operative midway the winding process, it is impossible to progressively increase or decrease the winding tension during winding operation so that the winding tension of thread rubber may continuously vary from the inside to the outside of the thread rubber layer.

SUMMARY OF THE INVENTION

An object of the present invention is to provide a winding method and apparatus for the manufacture of a wound golf ball which ensures efficient preparation of a wound core of quality by controlling the tension of thread rubber during winding for minimizing the hardness variation of a thread rubber layer, preventing rupture of thread rubber during winding, and improving a wound form.

Another object of the present invention is to provide a winding method and apparatus which can increase or decrease the winding tension of thread rubber continuously or stepwise during winding operation, producing a wound core having a thread rubber layer whose hardness varies continuously or stepwise in a thickness direction.

The winding method and apparatus of the invention is used in the manufacture of a wound golf ball comprising a wound core having thread rubber wound on a center and a cover enclosing the wound core.

According to a first aspect of the invention, there is provided a method for winding thread rubber on the center to form the wound core, comprising the steps of holding the center among at least three winding rollers, driving at least one winding roller for rotation to rotate the center, and feeding thread rubber to a surface of the rotating center through a brake roller and a delivery roller, thereby winding the thread rubber on the center under tension. According to the feature of the invention, the tension of the thread rubber is continuously measured at a position upstream of the center. The rotating condition of at least one of the winding roller, the brake roller, and the delivery roller is adjusted in accordance with the tension measurement, for adjusting the winding tension while winding the thread rubber on the center.

Preferably the outer diameter of the wound core is continuously measured while winding the thread rubber on the center. The winding tension of thread rubber is continuously or stepwise adjusted in response to a change of the diameter measurement and according to a preset tension program, producing a wound core in which the hardness of the thread rubber layer varies continuously or stepwise in a thickness direction.

According to a second aspect of the invention, there is provided an apparatus for winding thread rubber on the center to form the wound core, comprising winding means comprising at least three winding rollers supported for rotation, the winding means being adapted to hold the center among the rollers and to drive at least one winding roller for rotation to rotate the center, feed means comprising a rotatable brake roller and a rotatable delivery roller arranged for feeding thread rubber to the center held among the winding rollers through the brake roller and the delivery roller so that the thread rubber may be stretched by regulating a differential rotating condition between the brake roller and the delivery roller, the winding means cooperating with the feed means so as to wind thread rubber around the center, tension measuring means disposed between the delivery roller and the center held among the winding rollers for continuously measuring the tension of the thread rubber at a position upstream of the center, and tension adjusting means for adjusting the rotating condition of at least one of the winding roller, the brake roller, and the delivery roller in accordance with the measurement, for adjusting the winding tension. In this apparatus, while the thread rubber is wound on the center, the center is rotated at a high speed by the winding means, the thread rubber in a stretched state is fed to the rotating center by the feed means, the winding tension of thread rubber is continuously measured by the tension measuring means, and the winding tension is adjusted by the tension adjusting means in accordance with the tension measurement.

The winding apparatus may further include diameter measuring means for continuously measuring the outer diameter of the wound core while winding the thread rubber on the center. The winding tension of thread rubber is continuously or stepwise adjusted in response to a change of the diameter measurement by the diameter measuring means and according to a preset tension program. There is produced a wound core in which the hardness of the thread rubber layer varies continuously or stepwise in a thickness direction.

FUNCTION

According to the winding method of the invention, thread rubber is wound on a center under tension by holding the center among at least three winding rollers, driving at least one winding roller for rotation to rotate the center, and feeding thread rubber to a surface of the rotating center under tension through a brake roller and a delivery roller. According to the feature of the invention, the tension of thread rubber being wound on the center is continuously measured at a position upstream of the center. The rotating condition of at least one of the winding roller, the brake roller, and the delivery roller is adjusted in accordance with the tension measurement for adjusting the winding tension while winding the thread rubber on the center. Since the tension of thread rubber is stabilized during winding, a wound core of quality is produced in an efficient manner without a variation of hardness of the thread rubber layer, thread rupture during winding, and deformation of a wound form.

According to the winding method of the invention, the thread rubber is stretched under a predetermined tension due to a difference in rotating condition between the brake roller and the delivery roller and then delivered from the delivery roller to the rotating center. If desired, the thread rubber is given further tension between the delivery roller and the center due to a difference in rotating condition between the delivery roller and the winding rollers. Thus the thread rubber is wound on the center in a stretched state. The tension of thread rubber is continuously measured at a position upstream of the center. That is, the tension of thread rubber being wound on the center is continuously monitored. While adjusting the rotating condition of at least one of the brake roller, delivery roller and winding roller such that the winding tension is maintained at a desired level, winding of thread rubber is carried out. Since the thread rubber is wound around the center always under a constant winding tension, a wound core of quality is produced in an efficient manner without a variation of hardness of the thread rubber layer, thread rupture during winding, and deformation of a wound form. Since the winding tension is adjusted while continuously measuring the tension of thread rubber being wound on the center at a position upstream of the center, the winding tension can be stabilized even when the speed of winding thread rubber on the center is set at a very high level. This ensures fully efficient winding.

More particularly, a roller which does not rotate by itself, but is adapted to rotate when a predetermined rotational torque is applied thereto is used as the brake roller. Thread rubber is given a predetermined tension by guiding the thread rubber through the brake roller and then a delivery roller which is adjustable in speed. The thread rubber is fed to the spherical center which is rotating at a high speed with the aid of the winding rollers while the thread rubber is given further tension before it is wound on the center. The tension of the thread rubber is continuously measured between the delivery roller and the center. When the tension measurement is above the desired level, the speed of the delivery roller is instantaneously increased to reduce the tension of thread rubber. When the tension measurement is below the desired level, the speed of the delivery roller is instantaneously reduced to increase the tension of thread rubber. Since the tension of thread rubber being wound on the center is continuously measured, the winding of thread rubber is carried out while adjusting the winding tension on the basis of the tension measurement. Therefore, even when winding is carried out while rotating the center at a very high speed, the winding tension of thread rubber can be always stabilized at a desired level. A wound core of quality can be produced in an efficient manner without a variation of hardness of the thread rubber layer, thread rupture during winding, and a deviation of a wound form from sphericity. The means for adjusting the winding tension is not limited to the means for adjusting the speed of the delivery roller. Instead, the winding tension may be adjusted by properly controlling the rotating condition of the brake roller or winding roller or by controlling the rotating condition of at least two rollers of the delivery roller, brake roller and winding roller.

Additionally, according to the winding method of the invention, by measuring the winding tension of thread rubber as mentioned above, and continuously measuring the outer diameter of a wound core being formed by winding thread rubber on the center during winding, the winding tension of thread rubber can be adjusted in response to an increment of the outer diameter and in accordance with a preset tension program. There is obtained a wound core in which the hardness of the thread rubber layer varies continuously or stepwise in a thickness direction.

This process is described in more detail by referring to the embodiment wherein the number of revolutions of the delivery roller is adjusted. As mentioned above, the winding of thread rubber is carried out according to the winding method of the invention and the outer diameter of a wound core being formed by winding thread rubber on the center is continuously measured during winding. A tension value in the preset tension program corresponding to an outer diameter measurement is compared with an actual winding tension measurement of thread rubber. The speed of the delivery roller is adjusted such that the actual winding tension measurement may coincide with the programmed tension value. Therefore, if the tension program is set such that tension increases stepwise or continuously or such that tension decreases stepwise or continuously, there is obtained a wound core in which the hardness of the thread rubber layer varies stepwise or continuously in a thickness direction. A wound core of quality can be produced in an efficient manner without a variation of hardness of the thread rubber layer (or a deviation of hardness change), thread rupture during winding, and a deviation of a wound form from sphericity.

In this way, the winding method of the invention ensures that the tension of thread rubber is managed during winding for minimizing a variation of hardness of the thread rubber layer, preventing thread rupture during winding and improving a wound form, producing a wound core of quality in an efficient manner. When the tension of thread rubber is changed continuously or stepwise during winding, there is obtained a wound core in which the hardness of the thread rubber layer varies continuously or stepwise in a thickness direction.

The apparatus for winding thread rubber on a center to form a wound core according to the invention comprises winding means including at least three winding rollers for holding and rotating the center, feed means including a rotatable brake roller and a rotatable delivery roller, tension measuring means for measuring the tension of thread rubber at a position upstream of the center, and tension adjusting means for adjusting the rotating condition of at least one of the winding roller, the brake roller, and the delivery roller.

More particularly, the center is held among the three winding rollers of the winding means. At least one winding roller is driven for rotation to rotate the center at a high speed. Thread rubber is fed to the rotating center through the brake roller and then the delivery roller by the feed means. At this point, the thread rubber is stretched or given tension due to a difference in rotating condition between the brake roller and the delivery roller. The winding means cooperates with the feed means so as to wind thread rubber around the center in a stretched state or under tension. The tension of the thread rubber is continuously measured at a position upstream of the center by the tension measuring means. In accordance with the tension measurement, the rotating condition of at least one of the winding roller, the brake roller, and the delivery roller is controlled for adjusting the winding tension of thread rubber. Therefore, the winding apparatus ensures that the thread rubber is wound around the center under a stable winding tension according to the winding method of the invention and that a wound core of quality is produced in an efficient manner without a variation of hardness of the thread rubber layer, thread rupture during winding, and deformation of a wound form.

The tension adjusting means of the winding apparatus may be a tension controller which automatically adjust the rotating condition of at least one of the winding roller, brake roller and delivery roller in accordance with a tension measurement by the tension measuring means. While the winding tension is automatically adjusted by the tension controller, the thread rubber is wound on the center.

In the embodiment wherein the winding apparatus further includes diameter measuring means for continuously measuring the outer diameter of the wound core while winding the thread rubber on the center held among the winding rollers, the winding tension of thread rubber can be continuously or stepwise adjusted and a wound core in which the hardness of the thread rubber layer varies continuously or stepwise in a thickness direction can be produced.

More particularly, the outer diameter of a wound core being formed by winding thread rubber on the center is continuously measured during winding by the outer diameter measuring means. A tension value in the preset tension program corresponding to an outer diameter measurement is compared with an actual winding tension measurement of thread rubber. The rotating condition of at least one of the winding roller, brake roller and delivery roller is controlled by the tension adjusting means such that the actual winding tension measurement may coincide with the programmed tension value. By carrying out the winding of thread rubber in this way, the winding tension of thread rubber is changed continuously or stepwise in accordance with the preset tension program. There is obtained a wound core in which the hardness of the thread rubber layer varies continuously or stepwise in a thickness direction.

The winding apparatus may further include a tension change controller which detects from a measurement of the outer diameter measuring means that the outer diameter of a wound core has reached the preset diameter value, and automatically controls the rotating condition of at least one of the winding roller, brake roller and delivery roller in accordance with the preset tension program. Then the tension change controller automatically changes the winding tension continuously or stepwise to automatically change the winding tension of thread rubber, thereby producing a wound core in which the hardness of the thread rubber layer varies continuously or stepwise in a thickness direction.

BRIEF DESCRIPTION OF THE DRAWINGS

These and further features of the present invention will be apparent with reference to the following description and drawings, wherein.

DETAILED DESCRIPTION OF THE INVENTION

First Embodiment

Figure 1:
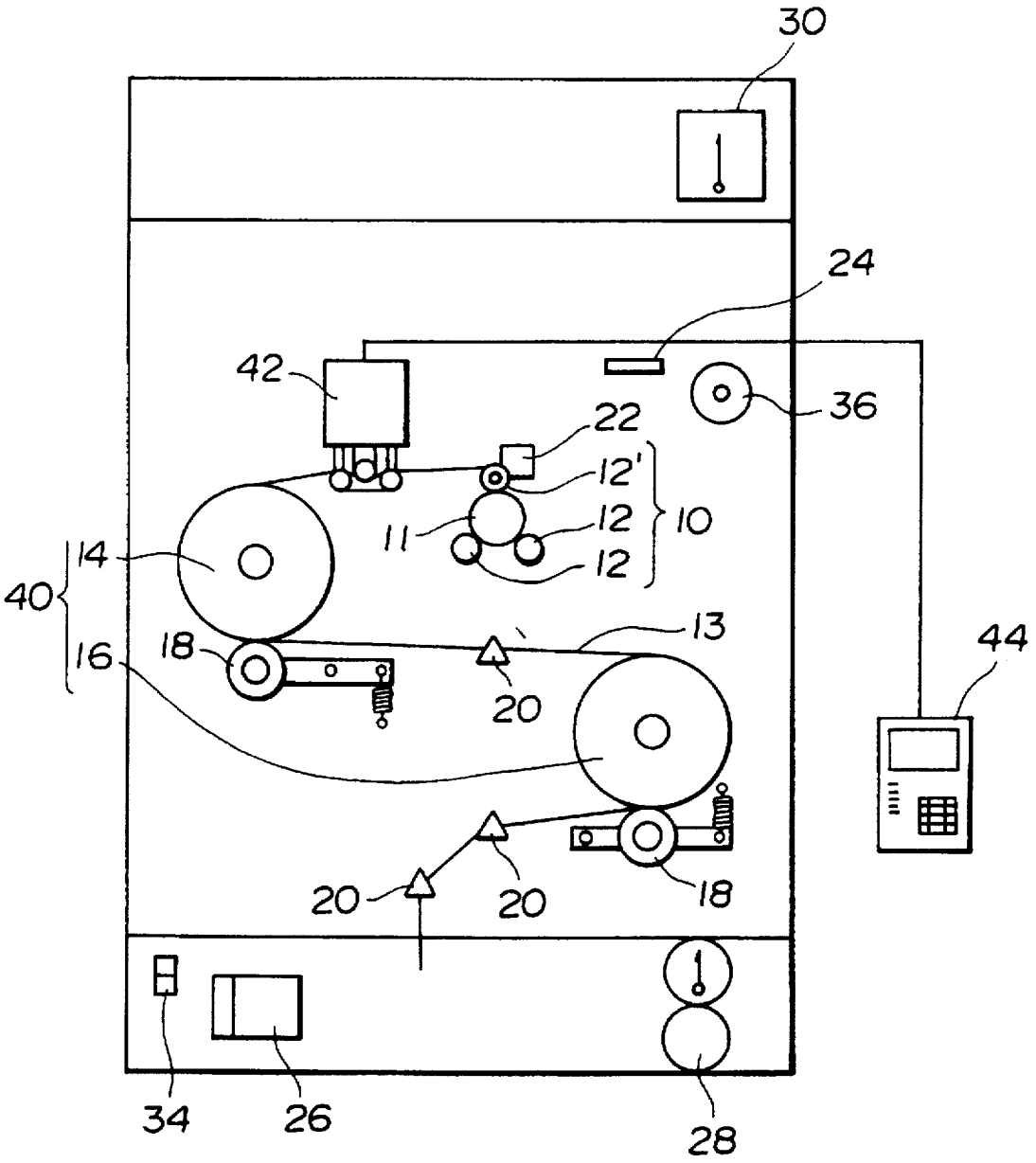
FIG. 1 is a schematic view of a winding apparatus according to a first embodiment of the invention.

Referring to FIG. 1, there is illustrated a winding apparatus according to a first embodiment of the invention. This winding apparatus is designed to wind thread rubber 13 around a spherical center 11 to form a wound core of a wound golf ball according to the winding method of the invention. The apparatus comprises a thread rubber winding section 10 including three winding rollers 12, 12, and 12' and a thread rubber feed section 40 including a delivery roller 14 and a brake roller 16.

In the thread rubber winding means 10, the three winding rollers 12, 12, and 12' are disposed at the apexes of a triangle. One roller 12' is disposed vertically above horizontally arranged rollers 12 and 12. The lower rollers 12 and 12 are adapted to be driven for rotation by a suitable drive (not shown) while the upper roller 12' is supported for rotation about its axis and for motion toward and away from the lower rollers 12 and 12. The upper winding roller 12' is an hourglass-shaped roller which is tapered toward the axial center from opposite ends. The hourglass roller 12' is biased downward toward the lower rollers 12 and 12 by means of a ball holder 22 for pressing the center 11 against the lower rollers 12 and 12 for thereby holding the center 11 among the three winding rollers 12, 12 and 12'. In this state, when the winding rollers 12 and 12 are driven for rotation, the center 11 is rotated therewith. The apparatus further includes a revolution setting section 26 for adjusting the number of revolutions of the winding rollers 12 and 12 and a pressure adjusting dial 28 for adjusting the pressure force of the ball holder 22 applied to the center 11.

In the thread rubber feed section 40, the brake roller 16 is supported for rotation. The brake roller 16 does not rotate by itself, but is adapted to rotate when a predetermined rotational torque is applied thereto. Included is an adjustment dial 30 for adjusting the rotational torque or resistance of the brake roller 16. The delivery roller 14 of the feed section 40 is adapted to be driven for rotation by a servo motor (not shown), which is coupled to a tension controller 44. The controller 44 controls the servo motor for adjusting the number of revolutions of the delivery roller 14. In the illustrated embodiment, the brake roller 16 is adapted to impart the rotational resistance by means of a loading mechanism of applying a load upon application of a voltage, which is known as a powder brake.

The thread rubber 13 is fed through the brake roller 16 and delivery roller 14 of the feed section 40 to the spherical center 11 held and rotating among the winding rollers 12, 12, and 12'. More particularly, the thread rubber 13 is driven forward by the delivery roller 14 through the brake roller 16 while the thread rubber 13 is stretched between the brake roller 16 and the delivery roller 14 by the rotational resistance of the brake roller 16 so that the thread rubber 13 is given a predetermined tension. Due to a difference in revolution between the delivery roller 14 and the center 11, the thread rubber 13 is further stretched between the delivery roller 14 and the center 11 so that the thread rubber 13 is given further tension. As a result, the winding tension is adjusted to a desired value when the thread rubber 13 reaches the center 11.

In the illustrated embodiment of the winding apparatus, a tension gauge 42 is disposed between the delivery roller 14 and the center 11 held among the winding rollers 12, 12, and 12' for measuring the tension of the thread rubber 13 at a position upstream of the center 11. The tension gauge 42 is electrically coupled to the tension controller 44. Then the tension of the thread rubber 13 being wound on the center 11 is continuously measured by the tension gauge 42, and an output (measurement) of the tension gauge 42 is automatically and continuously delivered to the tension controller 44.

In response to the winding tension of the thread rubber measured by the tension gauge 42, the tension controller 44 controls the servo motor associated with the delivery roller 14 for thereby continuously adjusting the delivery roller 14 to an appropriate rotational speed. Since a target value of winding tension is preset in the tension controller 44, the controller 44 compares the winding tension of the thread rubber measured by the tension gauge 42 with the target value of winding tension and automatically accelerates or decelerates the rotational speed of the delivery roller 14 in response to the result of comparison, thereby stabilizing the winding tension of thread rubber 13 at the preset target value.

Figure 7:
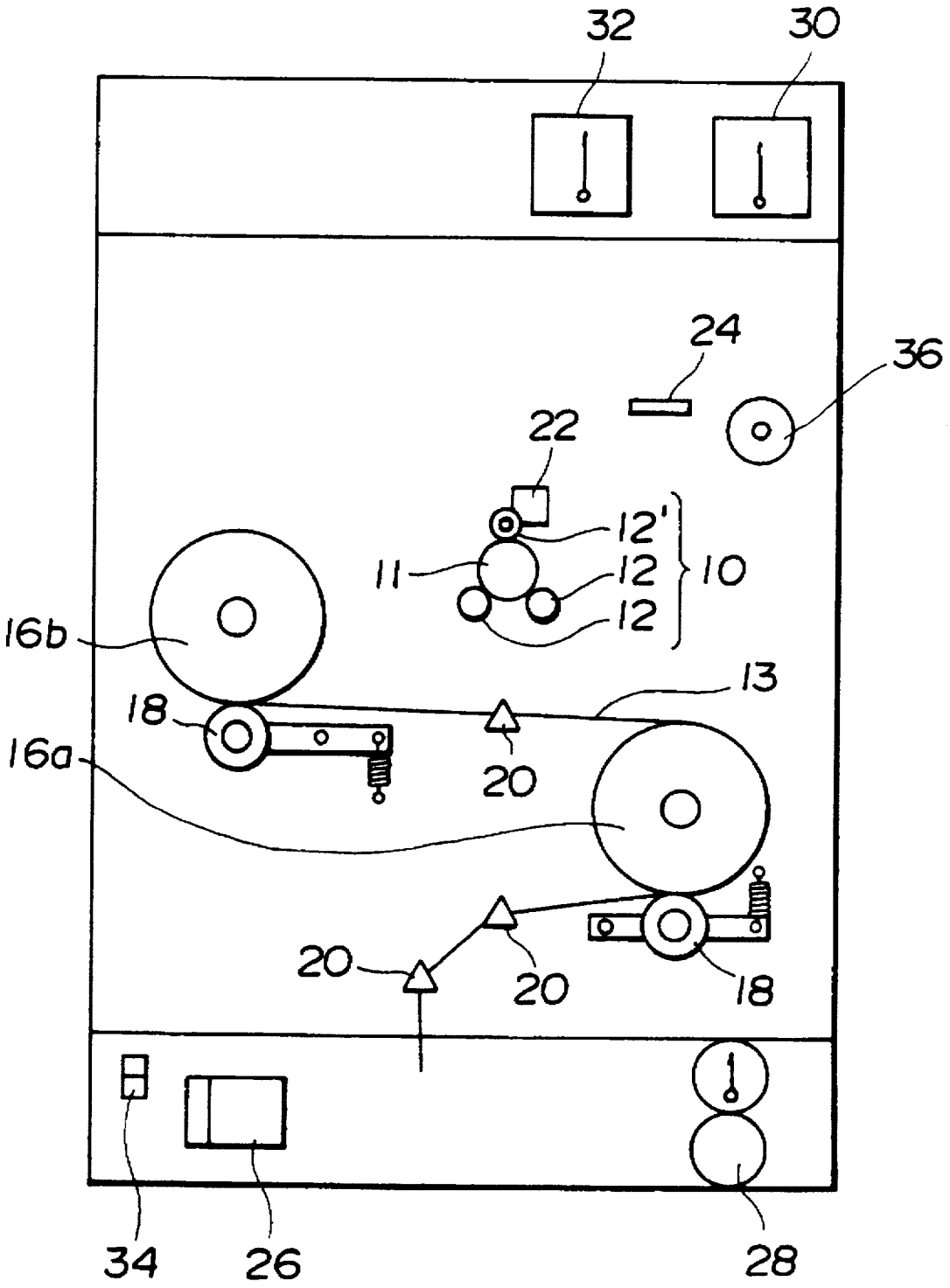
FIG.7 PRIOR ART
FIG. 7 is a schematic view of one prior art winding apparatus.
Figure 8:
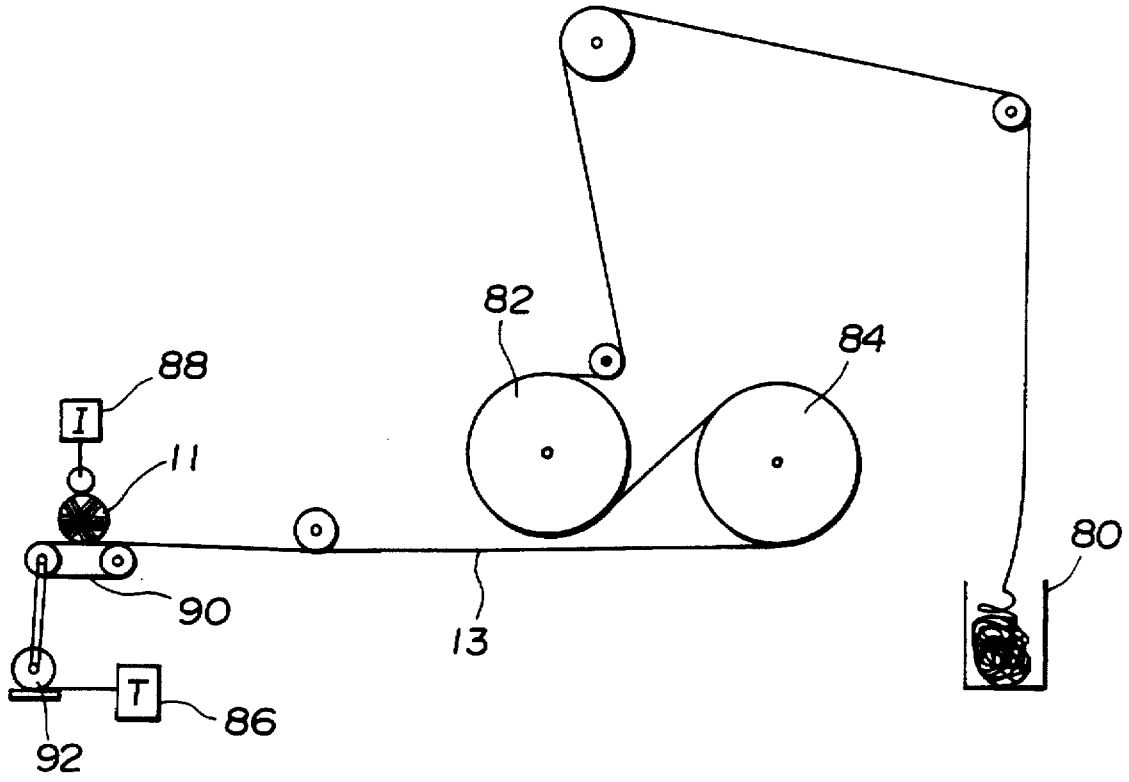
FIG.8 PRIOR ART
FIG. 8 is a schematic view of another prior art winding apparatus.
Figure 7:
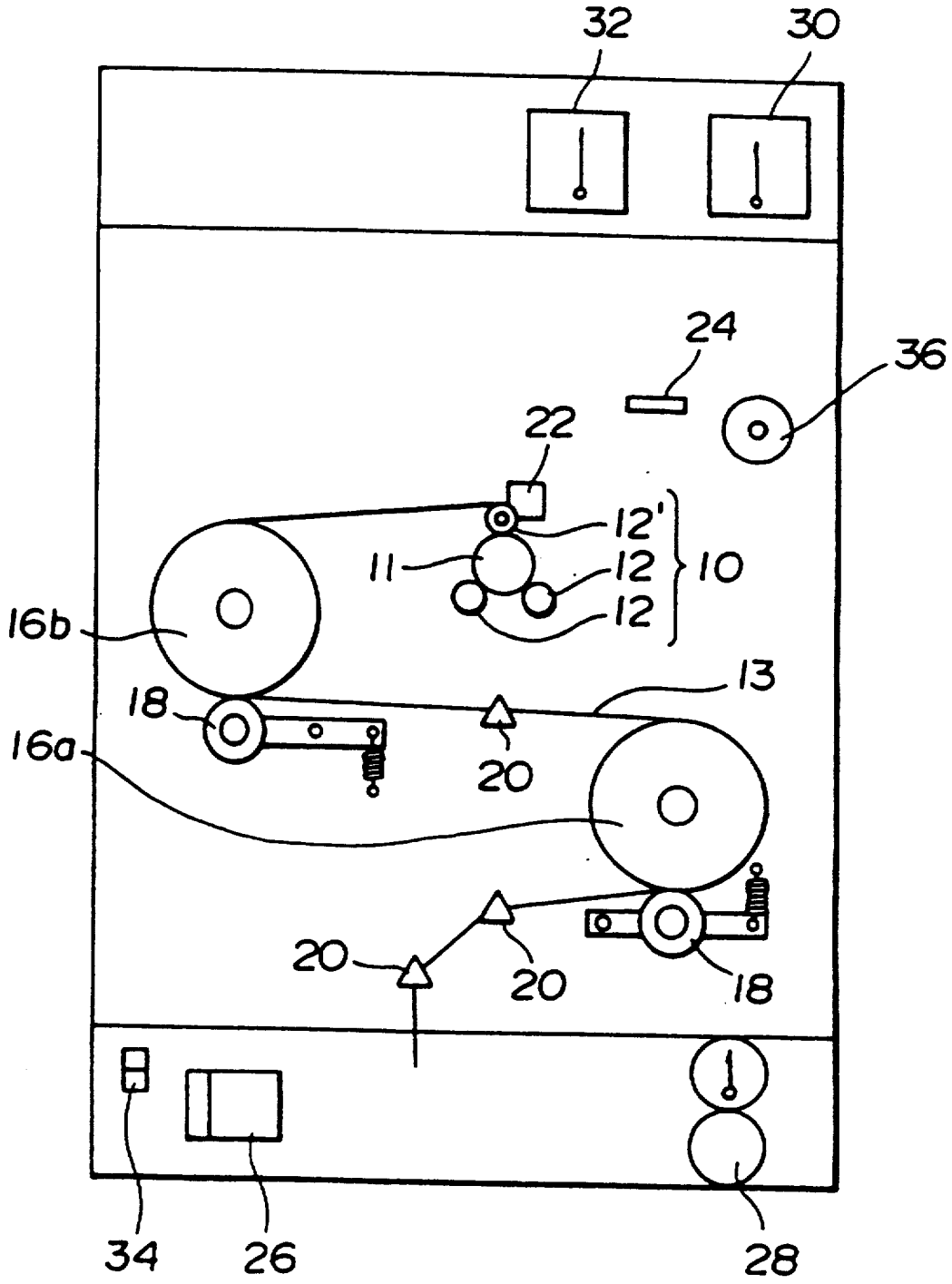

It is understood that the remaining members are the same as in the prior art winding apparatus shown in FIG. 7. Like parts are designated by the same numerals as in FIG. 7 and their description is omitted.

The operation of the winding apparatus will be described to explain how to wind thread rubber 13 around center 11 to form a wound core of a wound golf ball. The spherical center 11 is placed and held among winding rollers 12, 12, and 12' of winding section 10. A target value of winding tension is preset in tension controller 44. The revolution setting section 26 and pressure adjusting dials 28 and 30 are respectively adjusted for properly setting the number of revolutions of winding rollers 12 and 12, the pressure force of ball holder 22 applied to center 11, and the rotational resistance of brake roller 16. The apparatus is then actuated to drive winding rollers 12 and 12 for rotation for rotating center 11 and to rotate delivery roller 14 for delivering thread rubber 13 under tension to center 11.

In this way, thread rubber 13 is drawn in by delivery roller 14 through brake roller 16, delivered to the rotating center 11, and wound around center 11. During the process, thread rubber 13 drawn in by delivery roller 14 through brake roller 16 is stretched by the rotational resistance of brake roller 16 so that thread rubber 13 is given a predetermined initial tension between brake roller 16 and delivery roller 14. While thread rubber 13 is delivered from delivery roller 14 to center 11 and wound thereon, it is further stretched due to a difference in rotational speed between delivery roller 14 and center 11 so that thread rubber 13 is given a secondary tension between delivery roller 14 and center 11. The thread rubber 13 is adjusted to a final winding tension just when it is wound on center 11.

In the illustrated embodiment of the winding apparatus, the tension of thread rubber 13 is continuously monitored from the start to the end of winding at a position close to and upstream of center 11 by tension gauge 42. A measurement output of tension gauge 42 is continuously delivered to tension controller 44. The tension controller 44 compares the winding tension of the thread rubber measured by tension gauge 42 with the target value of winding tension preset therein. If the tension measurement is higher than the target value, controller 44 automatically controls the servo motor (not shown) to accelerate the rotational speed of delivery roller 14 to reduce the difference in revolution between delivery roller 14 and center 11 to reduce the winding tension. Similarly, if the tension measurement is lower than the target value, controller 44 automatically controls the servo motor to decelerate the rotational speed of delivery roller 14 to increase the difference in revolution between delivery roller 14 and center 11 to increase the winding tension. This automatic control operation is continuously carried out from the start to the end of winding, thereby stabilizing the winding tension of thread rubber at the preset target value throughout the winding process. As thread rubber 13 is wound around center 11 to increase the diameter of a wound core, the winding roller 12' is displaced upward. When the wound core reaches a predetermined diameter, instrument 24 detects the final outer diameter of the wound core to automatically stop the winding process.

Since the initial tension given to thread rubber 13 between brake roller 16 and delivery roller 14 is created by the rotational resistance of brake roller 16 as previously mentioned, the initial tension changes little even when the rotational speed of delivery roller 14 is changed under the control of tension controller 44. This is because a change of the rotational speed of delivery roller 14 merely leads to a change of the take-up speed of thread rubber 13. Therefore, a change of the rotational speed of delivery roller 14 adjusts the secondary tension applied to thread rubber 13 between delivery roller 14 and center 11. As a result, the tension of thread rubber 13 being wound on center 11 is adjusted.

It is noted that the initial tension applied between brake roller 16 and delivery roller 14 is preferably about 10 to 150%, especially about 80 to 120% of the final winding tension. The speed of center 11 by winding rollers 12, 12 should preferably be as high as possible in view of winding efficiency. Preferably center 11 is rotated at 500 to 2,500 rpm, especially 1,400 to 1,800 rpm. In accordance with the speed of center 11, the basic speed of delivery roller 14 is adjusted so as to provide the predetermined final winding tension. Additionally, under the control of tension controller 44, the rotational speed of delivery roller 14 is preferably adjusted within the range of about ±0% to ±30% of the basic speed.

In the winding method using the illustrated embodiment of the winding apparatus according to the invention, the winding tension of thread rubber 13 being wound on center 11 is measured by tension gauge 42, and the rotational speed of delivery roller 14 is adjusted by tension controller 44 on the basis of a tension measurement, whereby the winding tension is continuously adjusted while thread rubber 13 is being wound on center 11. Therefore, the winding tension of thread rubber 13 can be always stabilized at the target value of tension preset in tension controller 44. A wound core of quality is produced without a hardness variation of the thread rubber layer, thread rupture during winding and deviation of a wound form.

Furthermore, winding of thread rubber is carried out from its start to its end while the thread tension is continuously adjusted on the basis of an actual winding tension. This stabilizes the tension of thread rubber even when a very high winding speed is set. Even when the rise time of winding speed is set to a very short time, the winding tension of thread rubber can be instantaneously stabilized at the desired value. For example, when the rise time of winding speed is set to be 0 msec., thread rubber can be effectively wound without inconvenience such as thread rupture. Therefore, a wound core of quality is produced in a very efficient manner.

Moreover, since thread rubber 13 can be stably wound under the preset winding tension as mentioned above, a stable correlation can be established between the preset winding tension and the hardness of the resulting wound core. This ensures that the hardness of the resulting wound core is adjusted by the setting of winding tension.

Second Embodiment

Figure 2:
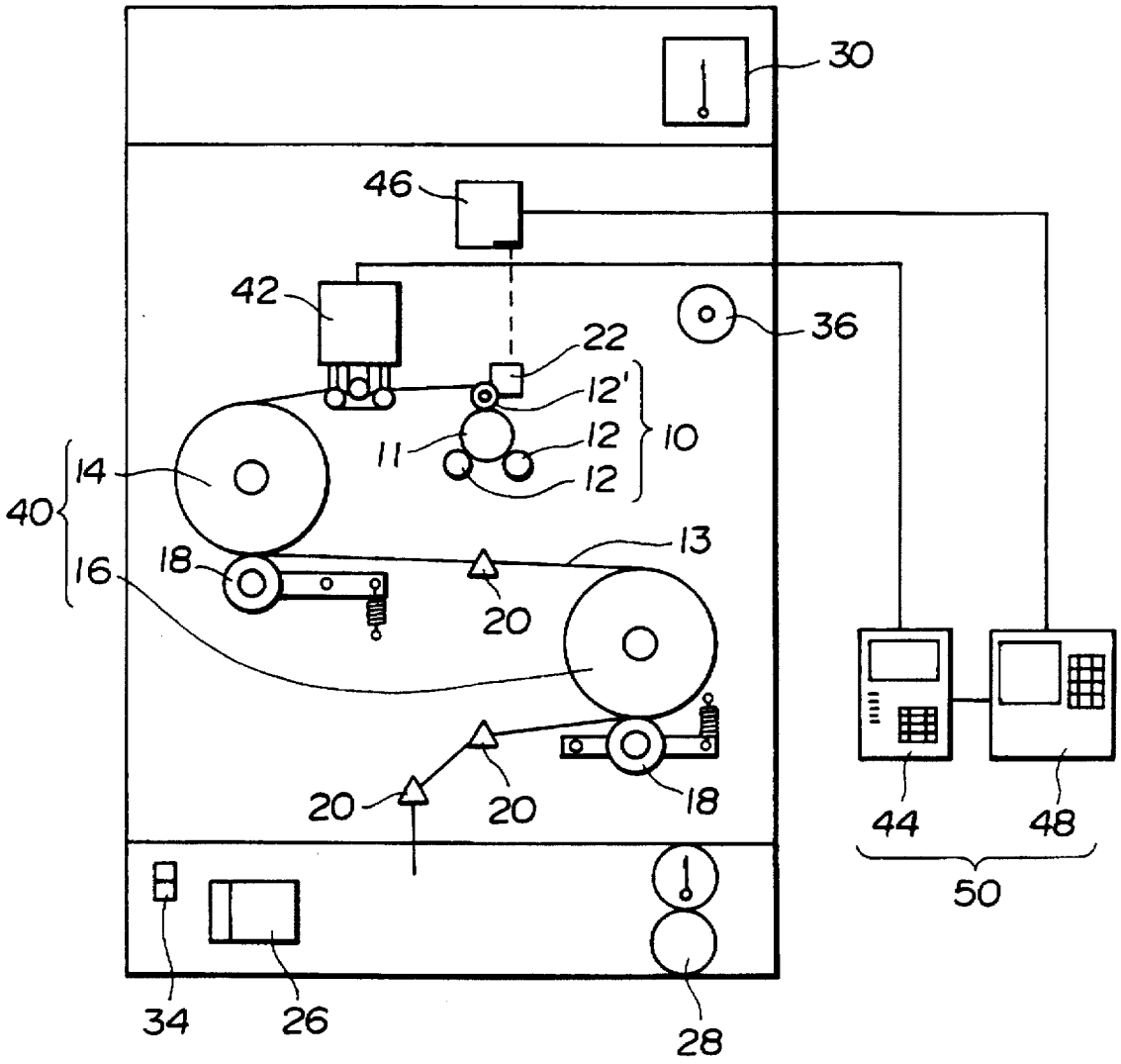
FIG. 2 is a schematic view of a winding apparatus according to a second embodiment of the invention.

FIG. 2 shows a winding apparatus according to a second embodiment of the invention. This embodiment is such that thread rubber 13 is wound around center 11 while changing the winding tension of thread rubber, thereby producing a wound core in which the hardness of a thread rubber layer varies in a thickness direction. Instead of the final diameter measuring instrument 24 in the first embodiment, the second embodiment uses a non-contact diameter measuring sensor 46 for continuously measuring the outer diameter of a wound core. The diameter sensor 46 is electrically coupled to a reference controller 48 which is coupled to the tension controller 44. When the measurement by the diameter sensor 46 reaches a predetermined value of outer diameter, the reference controller 48 delivers a signal to the tension controller 44 for changing the reference value of winding tension preset in the tension controller 44. The reference controller 48 and the tension controller 44 constitutes a variable tension control device 50. The remaining components are the same as in the first embodiment.

Now the operation of the winding apparatus according to the second embodiment is described to explain how to wind thread rubber 13 around center 11 to form a wound core in which the hardness of a thread rubber layer varies in a radial or thickness direction. The spherical center 11 is placed and held among winding rollers 12, 12, and 12' of winding section 10. A set of reference values of winding tension are preset in tension controller 44 such that the winding tension of thread rubber may successively vary from the inside to the outside of the thread rubber layer. A set of reference values of outer diameter at which the winding tension is to be changed are preset in reference controller 48. The revolution setting section 26 and pressure adjusting dials 28 and 30 are respectively adjusted for properly setting the number of revolutions of winding rollers 12, 12, the pressure force of ball holder 22 applied to center 11, and the rotational resistance of brake roller 16. The apparatus is then actuated to drive winding rollers 12, 12 for rotation for rotating center 11 and to rotate delivery roller 14 for delivering thread rubber 13 under tension to center 11.

As in the first embodiment of winding apparatus, the speed of delivery roller 14 is adjusted on the basis of the reference winding tension which is set in tension controller 44 in response to a tension measurement by tension gauge 42, whereby thread rubber 13 is wound around core 11 under consistent tension.

In the second embodiment of winding apparatus, while thread rubber is wound around core 11 to form a wound core, the outer diameter of the wound core is continuously monitored by the diameter measuring sensor 46. The diameter measurement is continuously delivered to reference controller 48. When the diameter measurement by the sensor 46 reaches the value of outer diameter (preset in reference controller 48) at which the winding tension is to be changed, reference controller 48 produces a signal to instruct a change of winding tension to tension controller 44. Upon receipt of this signal, tension controller 44 changes the reference winding tension (which is a reference on the basis of which tension is controlled) to a second stage winding tension and adjusts the speed of delivery roller 14 on the basis of the second stage winding tension. Consequently, the winding tension of thread rubber 13 is automatically changed when the outer diameter of the wound core reaches the predetermined value, and winding of thread rubber 13 is thereafter continued under the changed second stage winding tension in a stable manner, and so forth. Whenever the outer diameter of the wound core reaches a predetermined value, the winding tension of thread rubber 13 is automatically changed to the predetermined tension of the subsequent stage, and winding of thread rubber 13 is thereafter continued under the subsequent stage winding tension in a stable manner. When the outer diameter of the wound core reaches the final diameter, diameter measuring sensor 46 detects it and automatically stops the apparatus. The tension control operation other than a change of winding tension, that is, the tension control operation of carrying out winding while the winding tension of thread rubber 13 is stabilized at a predetermined tension is the same as in the first embodiment.

According to the second embodiment of winding apparatus, a set of values of winding tension of thread rubber 13 successively varying from the inside to the outside of the thread rubber layer are preset in tension controller 44 and a set of values of outer diameter at which the winding tension is to be changed are preset in reference controller 48. That is, a tension program is preset in variable tension control device 50. While thread rubber 13 is wound around center 11 to form a wound core, the outer diameter of the wound core is continuously measured by diameter sensor 46. In accordance with the tension program preset in tension controller 44 and reference controller 48, the preset tension corresponding to a measurement of outer diameter is compared with a measurement of winding tension of thread rubber 13 by tension gauge 42. While the speed of delivery roller 14 is adjusted such that the measurement may coincide with the preset tension, winding of thread rubber is continued. The winding tension of thread rubber 13 can be deliberately changed in accordance with the tension program. There is obtained a wound core in which the hardness of the thread rubber layer varies in a thickness or radial direction.

If the tension program is set such that the winding tension is changed stepwise at predetermined intervals (or predetermined outer diameters), the winding tension can be changed stepwise. If the tension program is set such that the outer diameters at which tension is to be changed are set at many fine increments and the winding tension is finely set so as to gradually increase or decrease, the winding tension can be changed continuously. Also, by changing the response time until the set tension is reached, the winding tension can be changed in a parabolic manner. Furthermore, when thread rubber 13 is wound while changing the winding tension continuously or stepwise as mentioned above, the winding of thread rubber takes place under the stable winding tension complying with the preset tension program, ensuring that a wound core of quality is effectively produced without allowing the hardness of the thread rubber layer to deviate from the design value (that is, without a variation of hardness change) and without thread rupture during winding and deviation of a wound form.

Additionally, the second embodiment provides similar advantages to those of the winding method and apparatus according to the first embodiment. The winding apparatus of the second embodiment can carry out winding operation in the same manner as the winding apparatus of the first embodiment if the tension program is set such that the winding tension is consistent from the start to the end of winding and the diameter measuring sensor 46 is used as a sensor for detecting the end of winding of thread rubber 13 like the final diameter measuring instrument 24 in the first embodiment.

Experiments are shown below by way of illustration.

Experiment 1

Figure 3A:
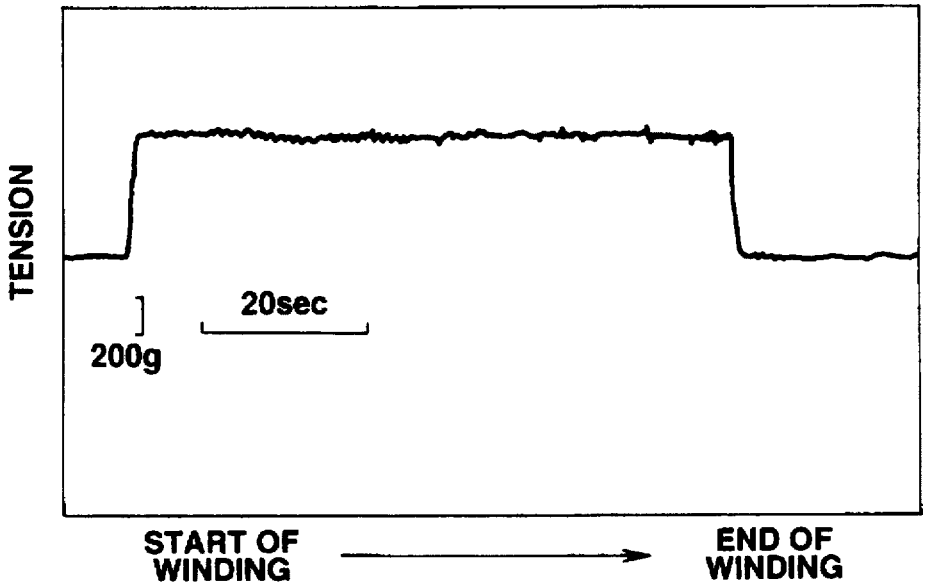
FIG. 3 is a graph showing how the winding tension of thread rubber varies from the start to the end of winding, FIG. 3A corresponding to a winding method according to the invention and FIG. 3B corresponding to a prior art winding method.

Using a winding apparatus of the second embodiment wherein the tension program was set such that the winding tension was maintained constant from the start to the end of winding, a wound core having a hardness of 2.0 was formed by winding thread rubber on a spherical core. Note that the hardness is expressed, relative to 0 under an initial load of 10 kgf, by a distortion (mm) of the core under a load of 130 kgf. The winding tension was monitored from the start to the end of winding and plotted in a graph. FIG. 3A is the graph showing a change of winding tension.

Figure 3B:
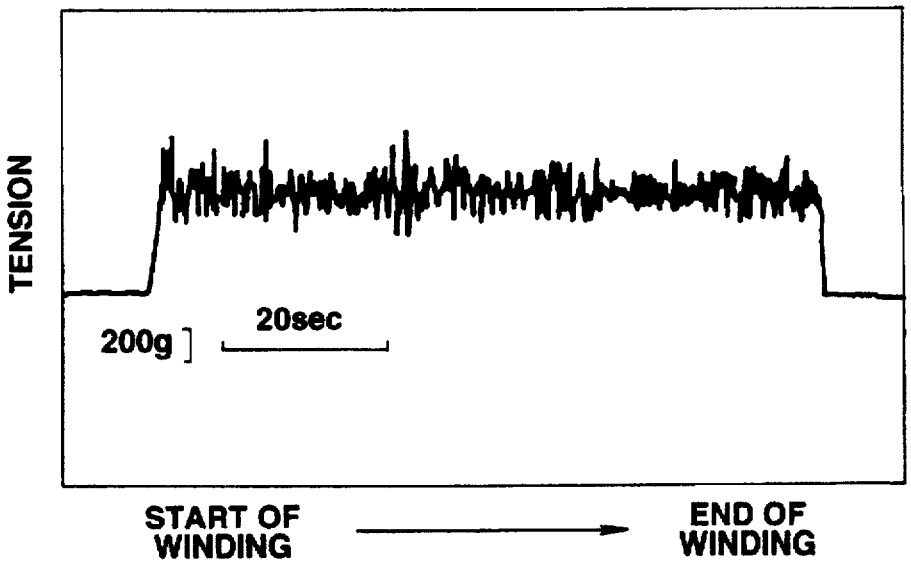

Separately, using a prior art winding apparatus as shown in FIG. 7, a wound core having a hardness of 2.0 was formed by winding thread rubber while the operator selected winding conditions relying on her experience. In this prior art winding apparatus, a tension gauge similar to the tension gauge 42 used in the second embodiment was disposed between the first brake roller 16*a* and the winding rollers 12, 12, 12' for measuring the winding tension of thread rubber 13 at a position upstream of the center 11. The winding tension was monitored from the start to the end of winding and plotted in the graph of FIG. 3B which shows a change of winding tension.

As seen from these graphs, when thread rubber was wound by the winding apparatus of the invention according to the method of the invention (FIG. 3A), the amplitude of tension was about 20 g (ripple factor: about 3%). Thread rubber could be wound under a constant winding tension. When thread rubber was wound by the prior art winding apparatus according to the prior art method (FIG. 3B), the amplitude of tension was about 200 to 400 g (ripple factor: about 67%), indicating that the winding tension was extremely unstable. It was acknowledged that the winding method and apparatus of the invention ensures that a wound core of quality is produced in an efficient manner without a deviation of the hardness of the thread rubber layer, deformation of a wound form, and inadvertent thread rupture during winding due to surging tension.

Note that the "ripple factor" used herein is calculated according to the equation: ripple factor=(maximum tension −minimum tension)/(average tension)×100%.

Experiment 2

Figure 4:
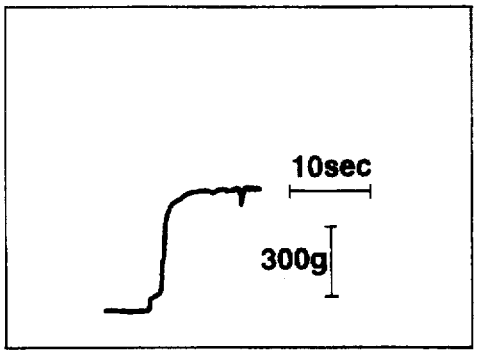
FIG. 4 is a graph showing a change of tension at the start of winding when winding of thread rubber is carried out by the winding method of the invention, provided that the rise time of winding speed is 0 msec.

Using a winding apparatus of the second embodiment, a wound core was formed by winding thread rubber on a spherical core under a winding tension of 300 g. Provided that the rise time or accelerating time at the start of winding was 0 msec., the winding tension was monitored at the start of winding and plotted in a graph. FIG. 4 is a graph showing a change of winding tension at the start.

As seen from FIG. 4, the winding method and apparatus of the invention ensures that the winding tension of thread rubber is instantaneously stabilized at the target value since no peak of tension occurred at the start of winding even if the rise time at the start of winding was 0 msec. Thread rubber can be wound in a very efficient manner without thread rupture and other troubles.

Experiment 3

In a winding apparatus of the second embodiment, a tension program was set such that the winding tension was maintained constant from the start to the end of winding. Seven wound cores were formed by winding thread rubber on a spherical core (frozen liquid center) under seven different winding tensions of 400 g, 500 g, 600 g, 700 g, 800 g, 900 g and 1,000 g. The wound cores were measured for hardness both immediately after winding and after thawing of the liquid center. The hardness of a wound core was plotted relative to the winding tension in FIG. 5.

Figure 5:
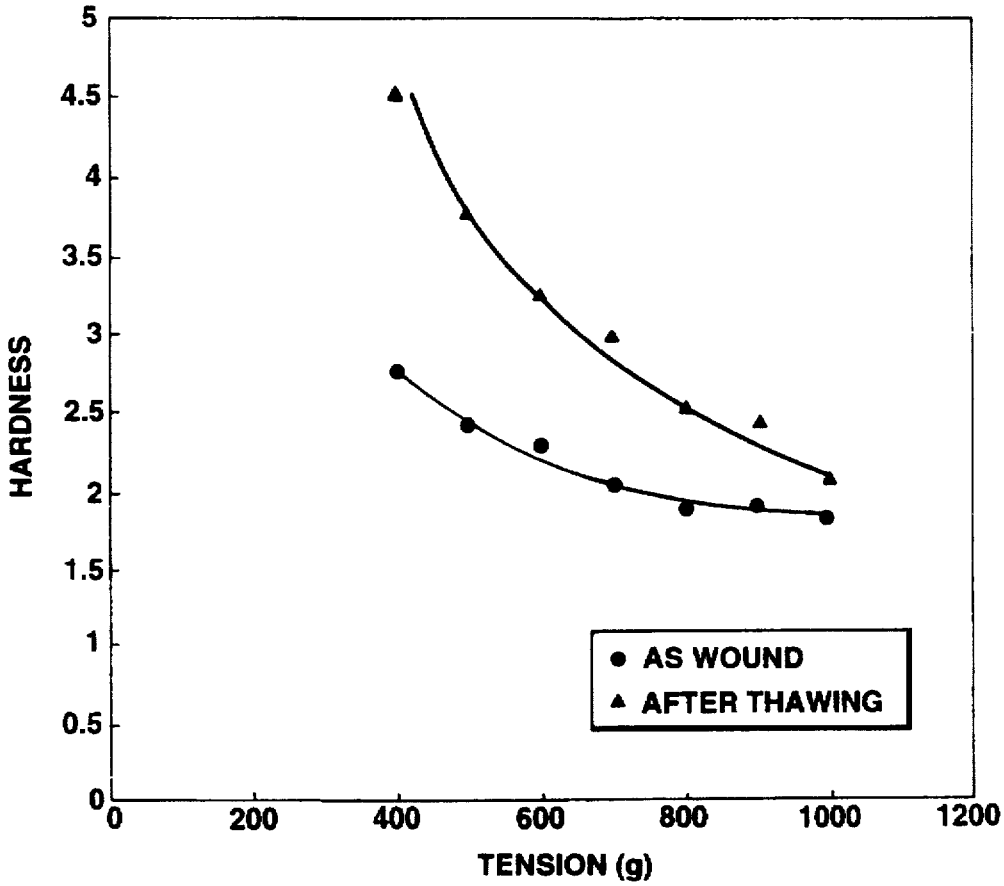
FIG. 5 is a graph showing the hardness of wound core relative to the winding tension of thread rubber when thread rubber is wound by the winding method of the invention.

As seen from the graph of FIG. 5, the winding method and apparatus of the invention establishes a stable correlation between the preset winding tension and the hardness of the resulting wound core. The hardness of the wound core can be adjusted in terms of the winding tension. It is understood from the results of FIG. 5 that for the thread rubber and core used herein, the correlation between the winding tension (T) and the hardness of a wound core is represented by the following equations.

Immediately after winding $$\text{Hardness} = 30.99 \times T^{-0.4097}$$

After thawing $$\text{Hardness} = 767 \times T^{-0.8549}$$

(The error range of hardness relative to tension is 0.2.) Therefore, a wound core having a desired hardness can be obtained by setting the winding tension according to these equations.

Experiment 4

Figure 6A:
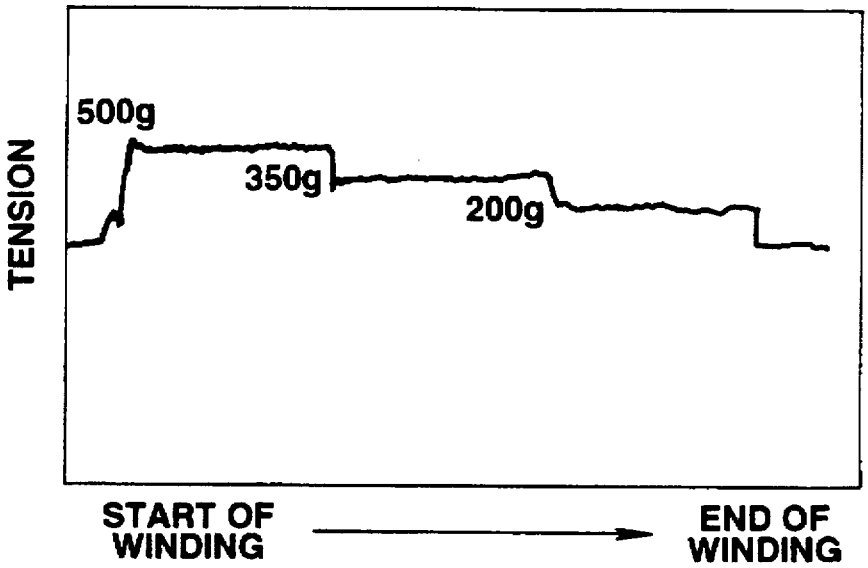
FIG. 6 is a graph showing how the winding tension of thread rubber varies from the start to the end of winding when the winding method of the invention is carried out while changing the winding tension of thread rubber, FIG. 6A corresponding to a stepwise change of winding tension and FIG. 6B corresponding to a continuous change of winding tension.

Using a winding apparatus of the second embodiment in which a tension program was set such that the winding tension was reduced in three stages from 500 g to 350 g and then to 200 g, a wound core was formed by winding thread rubber on a spherical core. The winding tension was monitored from the start to the end of winding and a change of the winding tension is depicted in a graph, which is shown in FIG. 6A. Also using a winding apparatus of the second embodiment in which a tension program was set such that the winding tension was gradually reduced from 550 g to 250 g, a wound core was formed by winding thread rubber on a spherical core. The winding tension was monitored from the start to the end of winding and a change of the winding tension is depicted in a graph, which is shown in FIG. 6B.

Figure 6B:
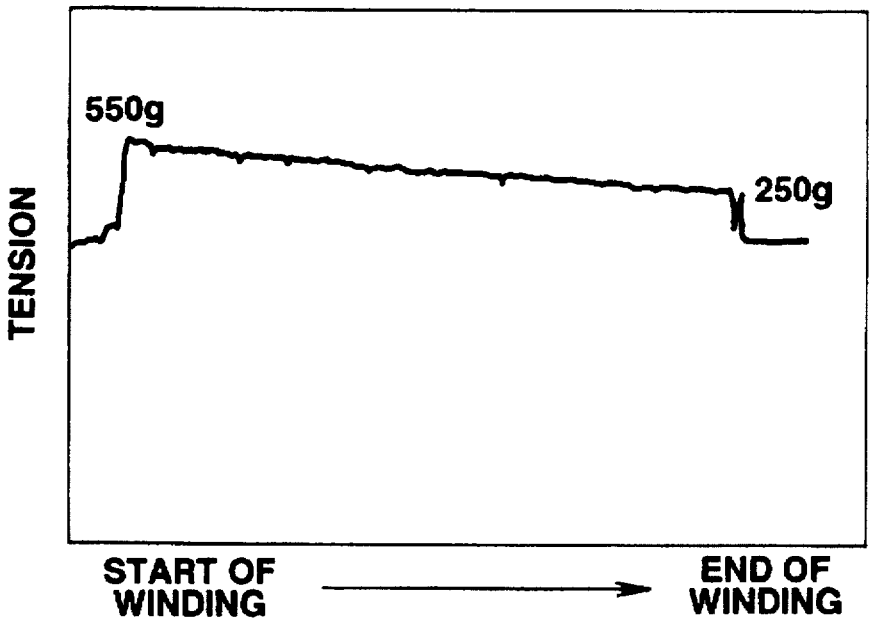

As seen from FIGS. 6A and 6B, the winding method and apparatus of the invention enables that the winding tension of thread rubber be changed stepwise (FIG. 6A) or continuously (FIG. 6B) according to the set tension program, thereby obtaining a wound core in which the hardness of the thread rubber layer changes stepwise or continuously in a thickness direction. Even when thread rubber is wound with the winding tension being changed stepwise or continuously, the amplitude of tension is very small so that thread rubber can be wound under a stable winding tension complying with the set tension program. The winding method and apparatus of the invention ensures that a wound core of quality is produced in an efficient manner without a deviation of the hardness of the thread rubber layer from the design value (a deviation from the programmed hardness change), deformation of a wound form, and inadvertent thread rupture during winding.

The winding method and apparatus of the invention is not limited to the above-mentioned embodiments and modifications may be made thereto. For example, in the first and second embodiments, the variable tension control device 50 consisting of the tension controller 44 and reference controller 48 is used to automatically adjust the rotating condition (speed) of the delivery roller 14. These controllers 44 and 48 need not be always used. It is acceptable that the winding tension of thread rubber is always monitored by the tension gauge 42 and the operator manually adjusts the rotating condition (number of revolutions) of the delivery roller 14 on the basis of the monitoring result. The winding tension adjusting means is not limited to the means for adjusting the number of revolutions of the delivery roller 14. Instead, the winding tension may be adjusted by properly controlling the rotating condition of the brake roller 16 and winding roller 12. Alternatively, the rotating condition of at least two rollers of the delivery roller 14, brake roller 16 and winding roller 12 may be controlled to adjust the winding tension. Although the delivery roller 14 is driven for variable speed rotation by the servo motor (not shown) in the first and second embodiments, the delivery roller 14 may be a second brake roller which does not rotate by itself, but is adapted to rotate when a predetermined rotational torque is applied thereto, like the brake roller 16, insofar as the torque required to rotate the roller is adjustable. Although the two rollers, delivery roller 14 and brake roller 16 constitute the thread rubber feed means in the illustrated embodiments, it is acceptable to constitute the thread rubber feed means from more than two rollers by adding another brake roller thereto. Modifications may be made to other components such as the number and drive of winding rollers 12 constituting the winding means 10 insofar as they are within the scope of the appended claims.

Since the winding tension of thread rubber is precisely controlled during winding, the winding method and apparatus of the invention ensures that a wound core of quality is produced without problems such as a deviation of the hardness of the thread rubber layer, deformation of a wound form, and inadvertent thread rupture during winding. When the tension of thread rubber is changed continuously or stepwise during winding, a wound core in which the hardness of the thread rubber layer varies continuously or stepwise in an thickness direction can be produced.

We claim:

1. In the manufacture of a wound golf ball comprising a wound core having thread rubber wound on a center and a cover enclosing the wound core, a method for winding thread rubber on the center to form the wound core, comprising the steps of;

holding the center among at least three winding rollers, driving at least one winding roller for rotation to rotate the center, feeding thread rubber to a surface of the rotating center through a brake roller and a delivery roller, thereby winding the thread rubber on the center under tension, continuously measuring the tension of the thread rubber at a position upstream of the center, and adjusting the speed of revolution of said delivery roller in accordance with the tension measurement, for adjusting winding tension of said thread rubber while winding the thread rubber on the center.

2. The winding method of claim 1 further comprising the steps of measuring the outer diameter of the wound core continuously while winding the thread rubber on the center, and adjusting the winding tension of the thread rubber continuously in response to a change of the diameter measurement and according to a preset tension program.

3. The winding method of claim 1 further comprising the steps of measuring the outer diameter of the wound core continuously while winding the thread rubber on the center, and adjusting the winding tension of the thread rubber in a stepwise manner in response to a change of the diameter measurement and according to a preset tension program.

4. In the manufacture of a wound golf ball comprising a wound core having thread rubber wound on a center and a cover enclosing the wound core, an apparatus for winding thread rubber on the center to form the wound core, comprising;

winding means comprising at least three winding rollers supported for rotation, said winding means being adapted to hold the center among the rollers and to drive at least one winding roller for rotation to rotate the center, feed means comprising a rotatable brake roller and a rotatable delivery roller arranged for feeding thread rubber to the center held among the winding rollers through the brake roller and the delivery roller so that the thread rubber may be stretched by regulating a differential speed of revolution between said brake roller and said delivery roller, said winding means cooperating with said feed means to wind thread rubber around the center, tension measuring means disposed between said delivery roller and the center held among said winding rollers for continuously measuring the tension of the thread rubber at a position upstream of the center, and tension adjusting means for adjusting the speed of revolution of said delivery roller in accordance with the tension measurement, for adjusting the winding tension, wherein the center is rotated at a high speed by said winding means, the thread rubber in a stretched state is fed to the rotating center by said feed means, the winding tension of thread rubber is continuously measured by said tension measuring means, and the winding tension is adjusted by said tension and adjusting means in accordance with the tension measurement while the thread rubber is wound on the center.

5. The winding apparatus of claim 4 wherein said feed means further comprises means for rotation of said brake roller at a predetermined rotational torque and means for rotation of said delivery roller at a variable speed of rotation, said tension adjusting means includes means for adjusting the speed of said delivery roller, wherein the thread rubber is fed through said brake roller and said delivery roller to the center held among the winding rollers, whereby the thread rubber is stretched to a predetermined rate of elongation between said brake roller and said delivery roller by the rotational resistance of said brake roller, and the speed of said delivery roller is adjusted by said tension adjusting means for adjusting the tension of the thread rubber being wound on the center.

6. The winding apparatus of claim 4 wherein said tension adjusting means includes a tension control device for automatically adjusting the rotating condition of at least one of said winding roller, said brake roller, and said delivery roller in accordance with the tension measurement by said tension measuring means, whereby the winding tension is automatically adjusted by said tension control device while the thread rubber is wound on the center.

7. The winding apparatus of claim 4 further comprising diameter measuring means for continuously measuring the outer diameter of the wound core while winding the thread rubber on the center, wherein the winding tension of said thread rubber is adjusted in response to a change of the diameter measurement by said diameter measuring means and according to a preset tension program.

8. The winding apparatus of claim 7 further comprising a tension change controller which detects from a measurement of the diameter measuring means that the outer diameter of a wound core has reached a preset diameter value, and automatically controls the rotating condition of at least one of the winding roller, brake roller and delivery roller in accordance with the preset tension program, for thereby automatically changing the winding tension.

9. The winding apparatus of claim 8 wherein said preset tension program continuously adjusts the winding tension of said thread rubber.

10. The winding apparatus of claim 8 wherein said preset tension program adjusts the winding of said thread rubber in a stepwise manner.

11. The winding apparatus of claim 7 wherein said preset tension program continuously adjusts the winding tension of said thread rubber.

12. The winding apparatus of claim 7 wherein said preset tension program adjusts the winding of said thread rubber in a stepwise manner.

* * * * *

UNITED STATES PATENT AND TRADEMARK OFFICE

CERTIFICATE OF CORRECTION

PATENT NO. : 5,697,574

DATED : December 16, 1997

INVENTOR(S) : Naoki MIYAKOSHI et al.

It is certified that error(s) appears in the above-identified patent and that said Letters Patent is hereby corrected as shown below:

Delete Figure 7 in its entirety, and replace it with the attached corrected Figure 7.

Signed and Sealed this

Seventh Day of July, 1998

Bruce Lehman

*Attest:*

BRUCE LEHMAN

*Attesting Officer*

*Commissioner of Patents and Trademarks*